US008584635B2

(12) United States Patent
Fessler

(10) Patent No.: US 8,584,635 B2
(45) Date of Patent: Nov. 19, 2013

(54) MECHANICAL VARIABLE VALVE ACTUATION SYSTEM FOR 2-STROKE AND 4-STROKE ENGINE OPERATIONS

(75) Inventor: Harald Fessler, Arbon (CH)

(73) Assignee: Iveco Motorenforschung AG, Arbon (CH)

( * ) Notice: Subject to any disclaimer, the term of this patent is extended or adjusted under 35 U.S.C. 154(b) by 0 days.

(21) Appl. No.: 13/261,311

(22) PCT Filed: Dec. 15, 2010

(86) PCT No.: PCT/EP2010/069721

§ 371 (c)(1), (2), (4) Date: Jun. 5, 2012

(87) PCT Pub. No.: WO2011/080076

PCT Pub. Date: Jul. 7, 2011

(65) Prior Publication Data

US 2012/0240889 A1 Sep. 27, 2012

(30) Foreign Application Priority Data

Dec. 16, 2009 (EP) ..... 09179453

(51) Int. Cl.
*F01L 1/34* (2006.01)

(52) U.S. Cl.
USPC ..... 123/90.17; 123/90.15

(58) Field of Classification Search
USPC ..... 123/90.41, 90.16, 90.39, 90.15
See application file for complete search history.

(56) References Cited

U.S. PATENT DOCUMENTS

2007/0209620 A1 * 9/2007 Seethaler et al. ..... 123/90.16

FOREIGN PATENT DOCUMENTS

| | | |
|---|---|---|
| DE | 19629349 | 1/1998 |
| DE | 102004006187 | 8/2005 |
| EP | 0780547 | 6/1997 |
| EP | 1619361 | 1/2006 |
| EP | 1666701 | 6/2006 |
| EP | 1816320 | 8/2007 |
| EP | 1835156 | 9/2007 |
| GB | 2323894 | 10/1998 |
| WO | WO2004044392 | 5/2004 |
| WO | WO2004085805 | 10/2004 |

* cited by examiner

*Primary Examiner* — Zelalem Eshete
(74) *Attorney, Agent, or Firm* — Stetina Brunda Garred & Brucker

(57) ABSTRACT

The invention relates to a mechanical variable valve actuation (VVA) system for the control and actuation of the valves of an internal combustion engine. The system according to the present invention realizes the control of the valve lift by means of a fixed pivot part for an oscillating rocker suitable to actuate the valve, the oscillating rocker being actuated by means of an eccentric control element.

14 Claims, 5 Drawing Sheets

MECHANICAL VARIABLE VALVE ACTUATION SYSTEM FOR 2-STROKE AND 4-STROKE ENGINE OPERATIONS

FIELD OF THE INVENTION

The present invention relates to a mechanical variable valve actuation (VVA) system for the control and actuation of the valve of an internal combustion engine. In particular, the present invention relates to a VVA system which allows a 2-stroke engine brake or fired operation.

DESCRIPTION OF THE PRIOR ART

As it is known, it is possible to control the pistons engines and achieve various functions by means of a valve actuation. In the most simple approach, a variation of cam position is applied to improve volumetric efficiency in the wide open throttle condition. As the intake valve closing event determines the real start compression, thus also the effective compression ration can be influenced. By variation of exhaust valve opening, the exhaust gas energy and consequently catalyst heat up as well as turbocharger performance can be influenced.

In view of the above, it can be easily understood that switching between different dedicated valve lift curves is even more effective in order to influence gas exchange or intake induced charge motion, even cylinder deactivation can be obtained by full valve deactivation.

Moreover, especially fully flexible variable valve actuation systems are considered as dedicated fuel economy concepts. By cam driven mechanical VVA systems, load control can be performed by means of early intake valve closing with minimized throttle losses.

Different VVA systems are already known in the art. For example, it is known to use a cam driven oscillating "profile" rocker to obtain a mechanical VVA. One example of such known systems is shown in FIG. 1. In this prior art system, the actuation system allows a 4-stroke engine operation. The variation of the valve lift profiles is realized by the rotation of the rocker 3 pivot part.

A drawback of this system in FIG. 1 is that it can not be used in 2-stroke engine braking or fired operation of the engine. This means that the system, as well as many others, is useful only for 4-stroke engine operations.

Therefore, it is an object of the present invention to provide a mechanical VVA system suitable to be used in 4-stroke as well as in 2-stroke engine braking or fired operations.

It is a further object of the present invention to provide a mechanical VVA system suitable to reduce the engine fuel consumption and emissions.

Another object is to provide a mechanical system which is highly reliable and relatively easy to manufacture at competitive costs.

SUMMARY OF THE INVENTION

The objects above are achieved by a mechanical variable valve actuation system as claimed in claim 1.

Said system, therefore, comprises a control element suitable to control by means of adjustable connection means the lift of the valve of a valve system. The adjustable connection means is a lever connection system suitable to connect said eccentric element with a driven shaft and with an oscillating rocker which engages the valve system. Said oscillating rocker comprises a first and a second lift profiles suitable for engaging said valve system.

BRIEF DESCRIPTION OF THE DRAWINGS

Further advantages of the present invention will become evident from the following detailed description of preferred but not exclusive embodiments and from the drawings herewith attached, which are merely illustrative and not limitative of the present invention, wherein.

DETAILED DESCRIPTION OF THE INVENTION

Figure 1:
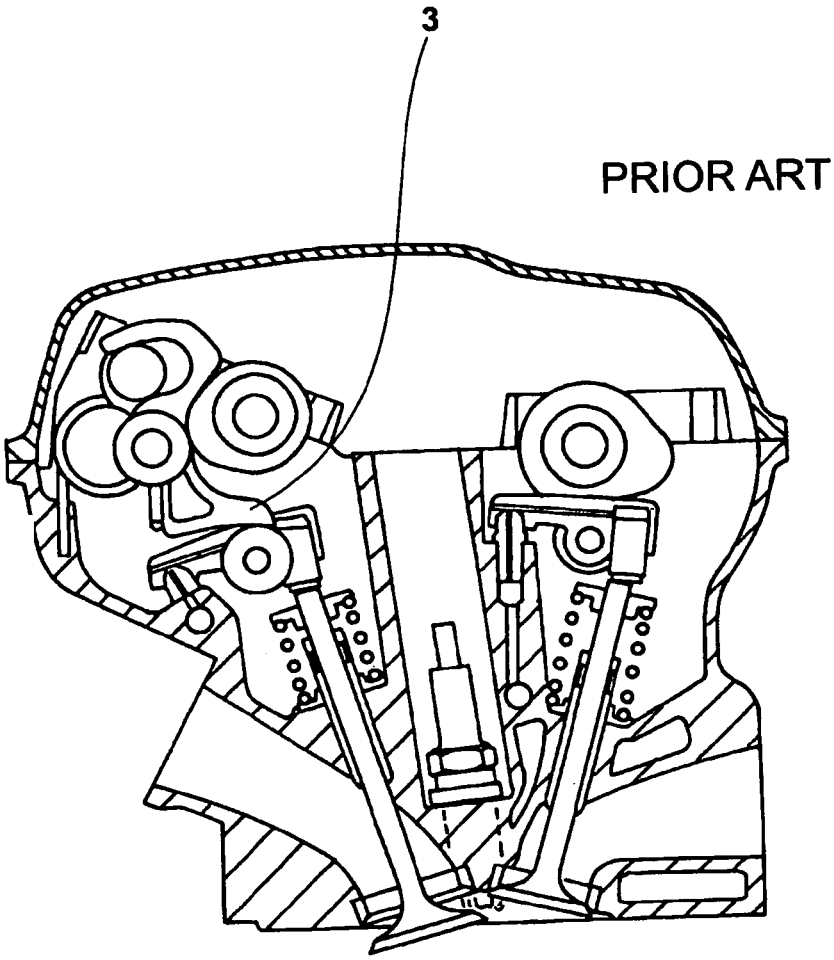
FIG. 1 represents a known mechanical variable valve actuation system.
Figure 2:
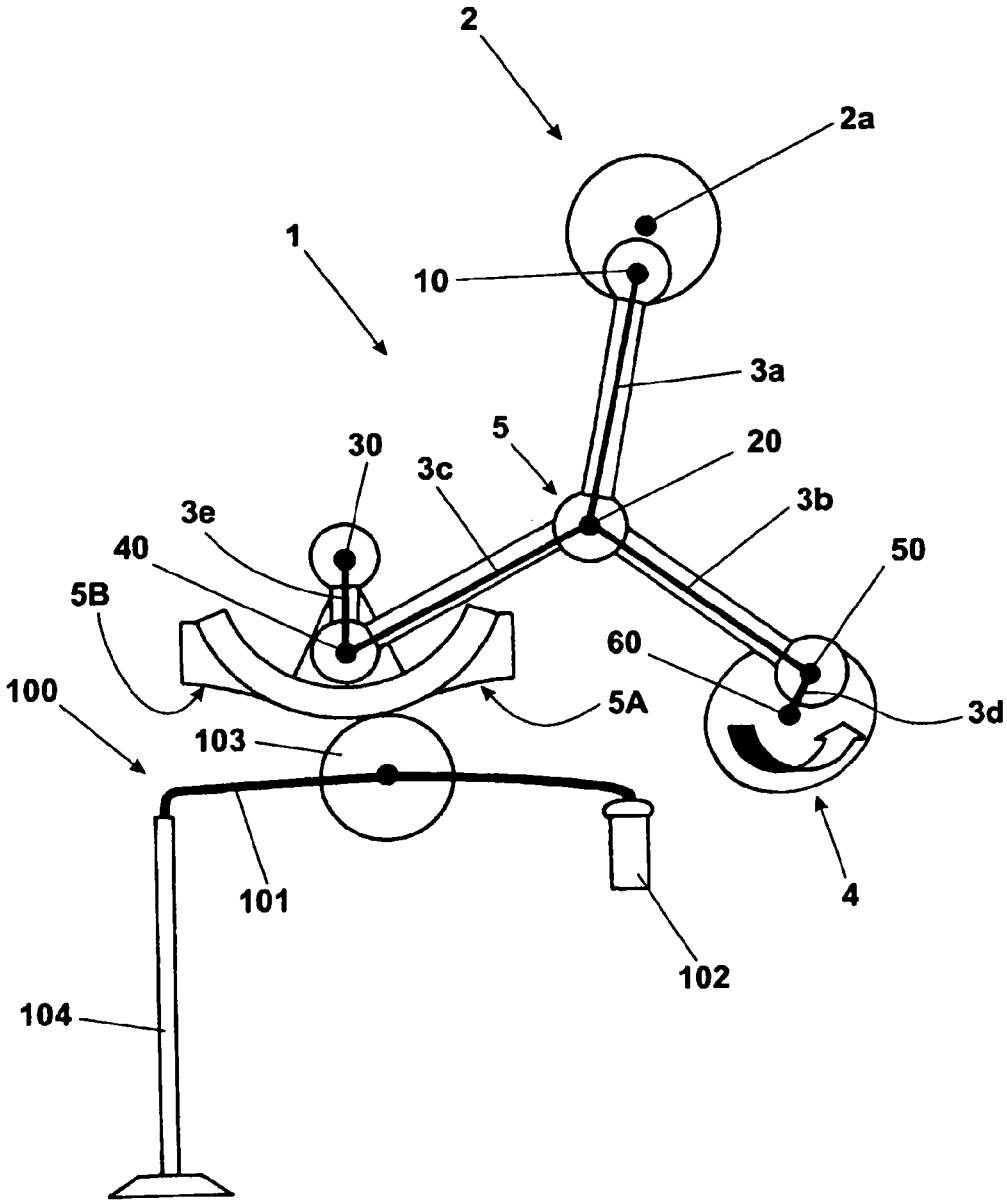
FIG. 2 schematically represents the mechanical variable valve actuation system according to the present invention.
Figure 2A:
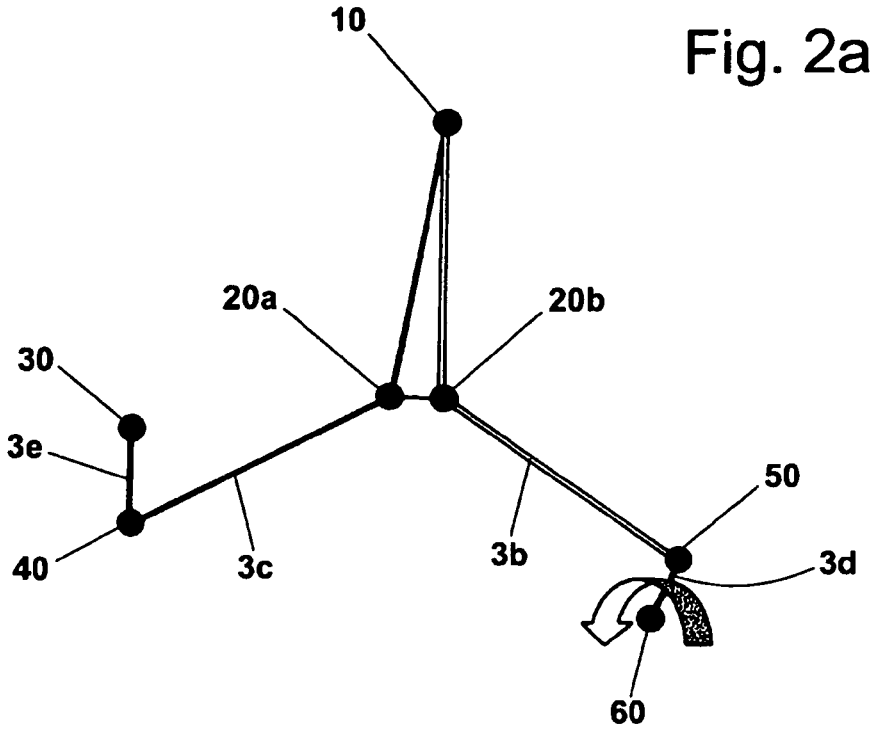
FIG. 2*a* represents a schematic representation of the actuation system of the present invention.
Figure 3:
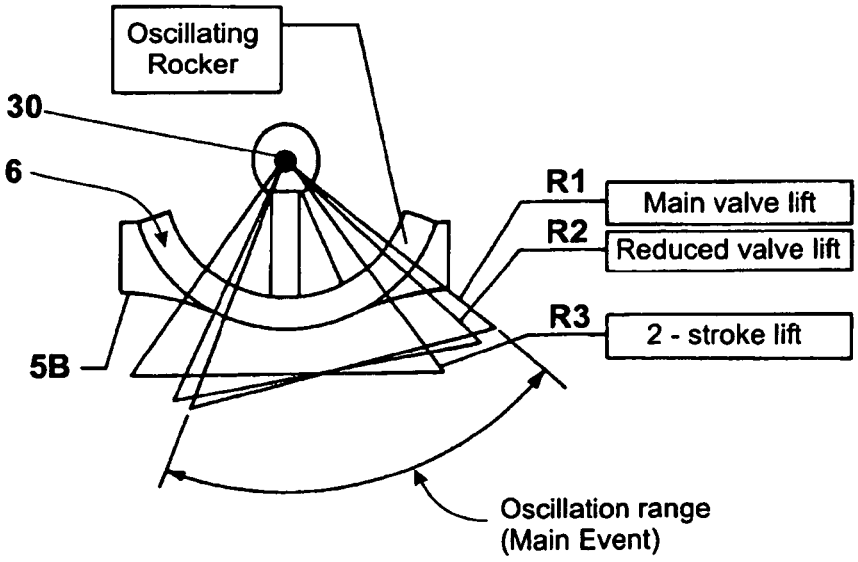
FIG. 3 schematically represents a detail of the oscillating rocker according to the present invention.

FIGS. 2, 2*a* and 3 show an internal combustion engine provided with a mechanical variable valve actuation system 1 according to the present invention. The valve actuation system 1 comprises a control element 2 which is connected by means of adjustable connection means to a valve system 100. The adjustable connection means comprise a lever connection system suitable to connect the control element 2 with a driven shaft 4 and with an oscillating rocker 6. The latter engages the valve system 100 and comprises a first lift profile 5A and a second lift profile 5B through which the oscillating rocker 6 activates the system valve 100.

As shown in said figures, the system valve 100 comprises at least a valve 104 (exhaust or inlet valve) which is moved by transmission means 101, 102, 103 activated by the profiles 5A,5B of the oscillating rocker 6. These transmission means are known in the art and can comprise an hydraulic lash adjuster 102, a rocker arm 101 connected to the valve 104 and a roller 103. In an alternative embodiment, the latter can be also a follower according to solutions known in the technical field.

According to the invention, the oscillating rocker 6 oscillates around a fixed part 30 in an oscillation range R1, R2, R3 which is established by a corresponding operative configuration of the control element 2. In detail, such an operative configuration is defined by a position of an operative part 10 of the control element 2.

The first lift profile 5A and the second lift profile 5B engage the valve system 100 in function of a relative oscillation range R1, R2, R3 established by the control element 2. That means that each oscillation range R1, R2, R3 corresponds to a specific valve lift characteristic. In other words, it is possible to modify the valve lift characteristic by modifying the position of the operative part 10 of the control element 2.

The control element 2 is preferably an eccentric element (hereinafter indicated with the same reference 2) whose rotation center is indicated in figures as 2*a*. The adjustable connection means comprises a lever connection system provided with five rods 3*a*, 3*b*, 3*c*, 3*d*, 3*e*. Each rod 3*a*, 3*b*, 3*c*, 3*d*, 3*e* has two ends. The first end of the first rod 3*a* corresponds to the operative part 10 of the control element 2. In particular, said operative part 10 can rotate along a circumference having its center in 2*a*. The position of the operative part 10 could be modified by means of a control element different than said eccentric element. In fact, the operative part 10 could be moved also in linear way by means of a control element comprising a shifting mechanism suitable to move linearly the operative part 10.

The second rod 3*b* has an end 50 which is connected to the driven shaft 4 by means of a fourth rod 3*d*. Therefore, a first four pivot system is defined by the four pivots 10, 20, 50 ad 60. The driven shaft 4 moves the pivot part 50 of the second rod 30*b* in an eccentric way advantageously avoiding the use of a cam.

The valve lift can be modified by means of the shifting of the first end 10 of the first rod 3*a*. In fact, the second end 20 of first rod 3*a* moves consequently to the movement of the first end 10. The second end 20 of the first rod 3*a* is connected by means of the knee joint 5 to the second rod 3*b* and to the third rod 3*c*.

The first end of the third rod 3*c* coincides with the pivot 20 of the knee joint 5, while the second end 40 of the third rod 3*c* is directly connected to the oscillating rocker 6. Said oscillating rocker 6 is rotatably associated with the pivot 40. A fifth rod 3*e* is further suitable to connect said pivot part 40 to a fixed pivot part 30. In particular the latter is the center of rotation of the oscillating rocker 6, while the pivot 40 establishes the angular oscillation of the rocker itself. Therefore, a second four pivot system is defined by the four pivots 10, 20, 40, 30.

FIG. 2*a* is relative to the lever connection system in which the pivot 20 is represented as shifted in the two pivots 20*a* e 20*b* in order to better show the two four pivot systems. A first pivot system is defined by the four pivots 10, 20*a*, 40 and 30, a second pivot system is defined by the four pivots 10, 20*b*, 50, 60.

A rotation of the eccentric element 2 modifies the valve lift by moving the working range (the oscillating range) of the profile rocker 6 to the left or to the right side by means of the displacement of the rocker pivot 40 caused by the movement of the third rod 3*c*. When the position of the angular oscillation of the rocker 6 is modified by the third rod 3*c*, the valve lift results to be modified accordingly by means of more or less engagement of the rocker lift profiles 5A, 5B with the valve roller 103 of the valve system 100.

FIG. 3 schematically shows a possible configuration of the oscillating rocker 6. As shown, the first lift profile 5A and the second lift profile 5B are symmetric with respect to a plane which crosses the rotation center 30 of the rocker 6 and which is perpendicular to the plane sheet. In FIG. 3 possible oscillation ranges R1, R2, R3 of the rocker 6 are also indicated. With the reference R1 it is indicated a first possible oscillation range defined by a corresponding first position of the operative part 10 of the control element 2. The first oscillation range R1 is so that only the first profile 5A engages the valve system 100 during the oscillation of the rocker 6. More in detail, the first position of the operative part 10 establishes a consequent first position of the fourth pivot 40 which moves the oscillation range of the rocker substantially to the right side. By the first oscillation range, it is possible to obtain a valve lift characteristic suitable for a 4-stroke engine operation.

Always in FIG. 3, a second oscillation range, indicated with reference R2, can be established by a second operative configuration of the control element 2 that corresponds to a second position of the operative part 10. The second oscillation range R2 is established so as to define valve lift lower than that obtainable by the first range R1. By the second range R2, an operation of an engine provided with an internal EGR could be performed.

A third oscillation range, indicated with reference R3, can be established by a third position of the operative part 10 of the control element 2. The third oscillation range R3 is so that both lift profiles 5A, 5B of the oscillating rocker 6 engage the valve system 100 (in particular the roller 103 shown in FIG. 2) during a complete oscillation of the rocker itself. This condition allows to have a lift characteristic when the rocker 6 move to the right side and another lift characteristic when it moves towards the other side. In other words, by the oscillation range R3 it is possible to double the frequency of lift of the valves. That means that a two-stroke engine fired or braking operation is possible.

Figure 4:
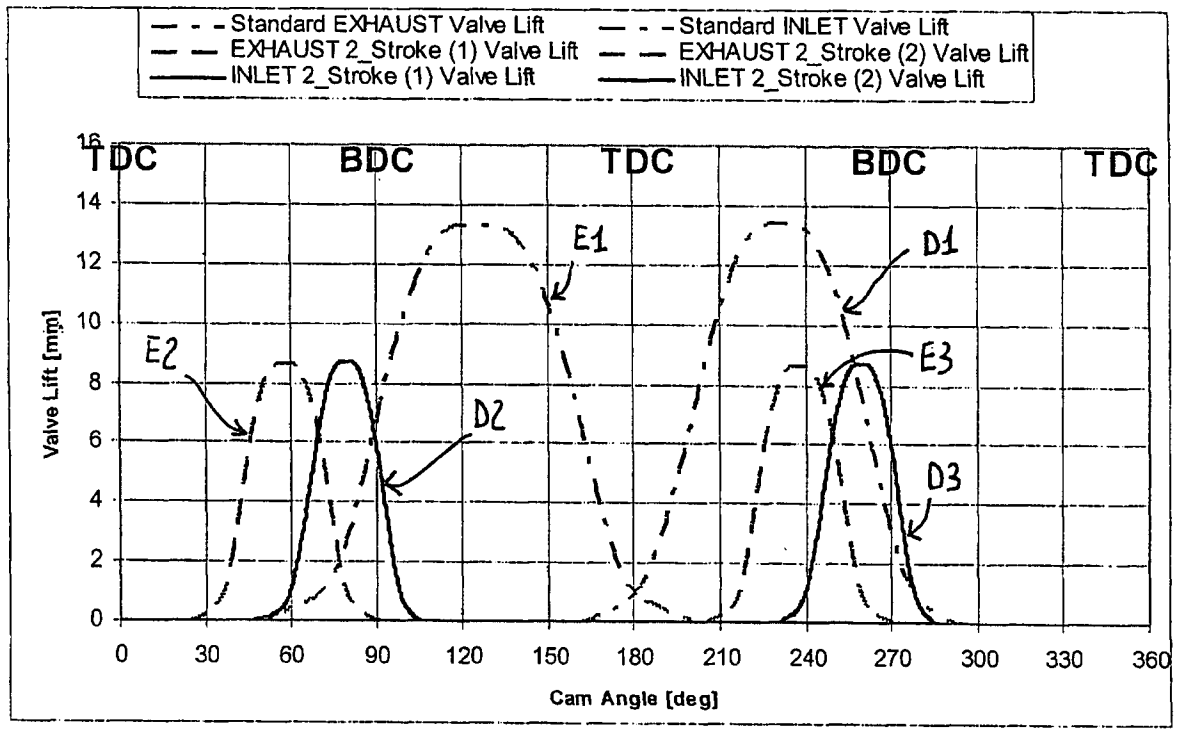
FIG. 4 is a valve lift diagram relative to a two stroke engine fired operation, of an engine provided with the valve actuation system according to the invention.

FIG. 4 shows exhaust valve lift characteristics (E1, E2, E3) and inlet valve lift characteristics (D1, D2, D3) of an engine provided with the VVA system according to the invention. In particular, lift characteristics shown in FIG. 4 are defined as function of the angular position of the driven shaft 4. In detail, references E1 and D1 indicate respectively the exhaust valve lift characteristic and the inlet valve lift characteristic relative to a 4-stroke engine operation. Such an operation mode requires a single lift of the valve during a cycle of the driven shaft 4. With reference to FIGS. 3 and 4, characteristics E1 and D1 could be achieved by setting the oscillation range R1 for the rocker 6.

In FIG. 3, references E2 and E3 indicate exhaust valve lift characteristics relative to a 2-stroke engine operation. Analogously references D2 and D3 indicate inlet valve lift characteristics relative to a 2-stroke engine operation. For such an engine operation, a doubled frequency of the valve lift is required. The VVA system 1 according to the invention allows to set up a corresponding oscillation range suitable for obtaining said frequency. With reference again to FIG. 4, both the lift profiles 5A,5B can engage the valve system 100 by setting the oscillation range R3. In this way, for each cycle of the driven shaft 4, exhaust and inlet valves are lifted two times, i.e. once by the action of the first profile 5A on the roller 103 and a second time by the action of the second profile 5B on the roller itself.

Figure 5:
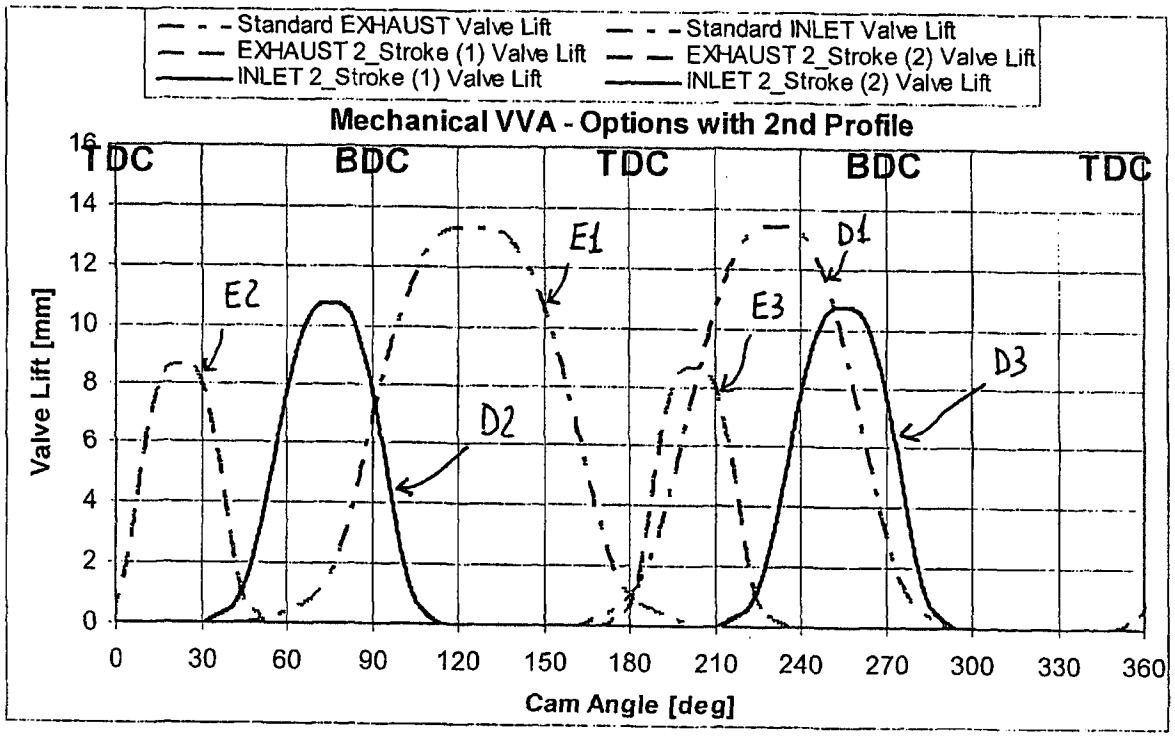
FIG. 5 is a valve lift diagram relative to a two stroke engine braking operation of an engine provided with the valve actuation system according to the invention.

FIG. 5 shows valve lift characteristics relative to a 2-stroke engine braking operation obtainable by means of the VVA system according to the present invention. As shown in FIG. 5, in this mode operation the exhaust valve lift is smaller than the inlet valve lift. This condition could be achieved by establishing an appropriate oscillation range for the oscillating rocker 6 and by optimizing geometry of the lift profiles 5A, 5B. In particular, the geometry of lift profiles designed to engage the inlet valve shall be different from the geometry of profiles designed to exhaust valves in order to obtain the different lift shown in FIG. 5.

According to the invention the VVA system can comprise a cam phaser in order to allow both 2-stroke mode operations and in particular to shift the lift profiles 5A,5B into the right angular position for braking.

It has been shown that the present invention achieves the aim and the objects proposed.

More in detail, it has been shown that the mechanical variable valve actuation system according to the present invention allows to accurately control the valve lift in order to optimize several different operation conditions. In particular the VVA system according to the invention enable both the 2-stroke engine operation or the four-stroke engine operation. With reference to the 2-stroke mode operation, the presence of two lift profiles allow a double valve lift frequency, while by means of the geometric optimization of said profiles it is possible to obtain a specific lift of the inlet and or exhaust valve. That means the VVA system of the invention allows to obtain both two/stroke engine braking and fired operation.

Moreover, the mechanical variable valve actuation system according to the present invention allows to improve the fuel consumption and emissions, especially by means of early inlet valve closing and modification of the valve overlap.

Not last, the variable valve actuation system of the present invention realizes the variation of the valve lift without using a cam in order to rotate the rocker profile which engages the valve, resulting in more accurate control of the valve lift.

It will be apparent to the person skilled in the art that other alternative and equivalent embodiments of the invention can be conceived and reduced to practice without departing from the true spirit of the invention.

From the description set forth above it will be possible for the person skilled in the art to embody the invention without introducing any further construction details.

The invention claimed is:

1. Mechanical variable valve actuation system (1) characterized in that it comprises a control element (2) which controls by means of adjustable connection means the lift of at least a valve (104) of a valve system (100), said adjustable connection means being a lever connection system which connects said control element (2) with a driven shaft (4) and with an oscillating rocker (6) which engages the valve system (100), wherein said oscillating rocker (6) comprises a first (5A) and said second lift profiles (5B) for engaging said valve system (100).

2. Mechanical VVA system according to claim 1, wherein said oscillating rocker (6) oscillates around a fixed part (30) in an oscillation range which is established by the operative position of said control element (2), said first (5A) and said second profile (5B) engaging said valve system in function of said oscillation range.

3. Mechanical VVA system according to claim 2, wherein said control element (2) establishes a first oscillating range (R1) for which only said first lift profile (5A) engages said valve system (100) during the oscillation of said oscillating rocker (6).

4. Mechanical VVA system according to claim 3, wherein said control element (2) establishes a second oscillating range (R2) for which both lift profiles (5A,5B) engage said valve system (100) during the oscillation of said oscillation rocker (6).

5. Mechanical VVA system according to claim 1, wherein said control element (2) is an eccentric element.

6. Mechanical VVA system according to claim 1, wherein said control element (2) is a linear element.

7. Mechanical VVA system according to claim 1, wherein said lever connection system comprises five rods (3*a*,3*b*,3C, 3*d*,3*e*).

8. Mechanical VVA system according to claim 7, wherein each end (10, 20, 30, 40, 50) of said five rods (3*a*,3*b*,3C,3*d*, 3*e*) is a pivot part.

9. Mechanical VVA system according to claim 7, wherein said first rod (3*a*) of said five rods has a first end (10) which is suitable to be moved eccentrically around a centre (2*a*) of said eccentric element (2).

10. Mechanical VVA system according to claim 9, wherein said second end (20) of said first rod (3*a*) is connected to the first end of a second (3*b*) and third (3*c*) of said five rods in a knee joint (5).

11. Mechanical VVA system according to claim 10, wherein said second end (50) of said second rod (3*b*) is connected to the first end of a fourth rod (3*d*), the second end (60) of said fourth rod (3*d*) being the center of rotation of the driven shaft (4).

12. Mechanical VVA system according to claim 7, wherein said second end (40) of said third rod (3*c*) is connected to the first end of a fifth rod (3*e*), the second end (30) of said fifth rod (3*c*) being a fixed pivot part for the rocker (6) oscillation.

13. Mechanical VVA system according to claim 7, wherein said rod ends define a first (10, 20, 50, 60) and a second (10, 20, 30, 40) pivot systems by means of which said control element (2) can modify and control the valve (104) lift.

14. Mechanical VVA system according to claim 7, characterized in that said rocker (6) oscillates around the fixed pivot (30) the oscillating range of said rocker (6) being controlled and modified by means of the position of the pivot (40), the position of the pivot (40) being determined by the movement of the third rod (3*c*) which is moved as a function of the position of the first end (10) of the first rod (3*a*) with respect to the center (2*a*) of the eccentric element (2).

* * * * *